United States Patent [19]

von der Eltz

[11] 4,139,344

[45] Feb. 13, 1979

[54] PROCESS FOR THE CONTINUOUS DYEING OF WOOL

[75] Inventor: Hans-Ulrich von der Eltz, Frankfurt am Main, Fed. Rep. of Germany

[73] Assignee: Hoechst Aktiengesellschaft, Frankfurt am Main, Fed. Rep. of Germany

[21] Appl. No.: 823,154

[22] Filed: Aug. 9, 1977

[30] Foreign Application Priority Data

Aug. 11, 1976 [DE] Fed. Rep. of Germany ..... 2635991

[51] Int. Cl.[2] ..... D06P 3/82; C09B 45/00

[52] U.S. Cl. ..... 8/21 R; 8/1 A; 8/22; 8/42 R; 8/43; 8/54; 8/85 R; 8/89 A; 8/93

[58] Field of Search ..... 8/1 A, 21 R, 43, 85 R, 8/89 A, 93, 22, 42 R, 54

[56] References Cited

U.S. PATENT DOCUMENTS 4,063,877 12/1977 Elliot et al. ..... 8/1 A

FOREIGN PATENT DOCUMENTS 607179 8/1961 Belgium.
1287558 1/1969 Fed. Rep. of Germany.
7410432 2/1975 Netherlands.

OTHER PUBLICATIONS

Lewis, D. M and Seltzer, I. J. Soc. Dyers and Colourists, 1968, 84, pp. 501–507.
Soiron, C. et al., Textilveredlung, 1972, 7, (No. 1), pp. 24–27.

*Primary Examiner*—A. Lionel Clingman
*Attorney, Agent, or Firm*—Curtis, Morris & Safford

[57] ABSTRACT

Process for the continuous dyeing of flat textile articles made of wool or their mixtures with synthetic fibers by means of 1:2 or 1:1 metal complex dyestuffs or by means of reactive dyestuffs, according to a pad-hot-dwell method, by padding a web of said textile material with an aqueous liquor containing a solution of said dyestuffs together with a hydrotropic substance, placing the material thus treated, continuously and without interediate drying, into a heated dwelling chamber, submitting the material in said chamber, during its passage in cuttled-up state, to the action of heat so that the dyestuff is fixed by the dwelling operation, and finally withdrawing the dyed material again continuously from the dwelling chamber.

4 Claims, No Drawings

PROCESS FOR THE CONTINUOUS DYEING OF WOOL

The technical information paper D 1293 published by ICI discloses a process for the dyeing of wool by a pad-cold-dwell method using reactive dyestuffs, according to the recommendations of the IWS (International Wool Secretariat). Furthermore, metal complex dyestuffs are also used in the pad-cold-dwell process for dyeing wool, according to P.D. Report No. 136, "Further Development of the Pad-Batch-Process" published in April 1971 by the Secretariat.

In said process the dyestuff fixation on the wool fibers is made possible by the addition of urea to the padding liquor at a rate of 300 g/l. The so-called "cold-dwell process" which has been reported in detail in the journal "Textilveredlung" 7 (1972), No. 1, pages 24–27 and been disclosed in German Auslegeschrift No. 1,287,558 is based on a similar dyeing technique.

This kind of dyeing wool is generally considered to be a novel, semi-continuous and fiber-protecting method. Hitherto, however, this process has not been used in practice on a large scale. The main reason therefore certainly resides in the fact that the exploitation of the dyes and correspondingly the color yield of the dyeings is not satisfactory. Moreover a tendering of the woollen material, inspite of the cold-dwelling procedure, cannot be excluded since extremely high amounts of urea must be used. A continuous process of said kind has not become known hitherto and is not possible because of the prolonged periods of time for fixation.

For a long time various processes are also known in which wool is padded with acid-containing dyeing baths. Thereby the dyestuff fixation is achieved by steaming for a certain period of time (of from 20 minutes to several hours). According to this state of the art, the process is carried out as disclosed in British Pat. No. 869,150 using a dyeing preparation which contains an acid or an acid salt, a cationic surface-active auxiliary, a non-ionic dispersing agent, and an amine, an alcohol or a phenol. The acid content in this case ranges preferably between 1 and 5%, calculated on the weight of the material to be dyed.

It is further known from Belgian Pat. No. 607,179 to dye and to print natural or man-made polyamide fibers with wool dyestuffs in the presence of coacervating auxiliaries. The weight ratio between water and auxiliary in this case should be chosen in a way to make coacervation possible and to assure that in this two-phase system the phase which contains the higher amount of auxiliary represents at least 20% of the aqueous preparation. The material thus impregnated is then submitted, without intermediate drying, to steaming in a saturated steam atmosphere having a temperature of at least 60° C.

German Auslegeschrift No. 2,340,044 finally discloses a continuous process for the dyeing of wool by means of specially pre-treated reactive dyestuffs. In this case the fixation of the dyestuffs which have previously been reacted with methyltaurine is achieved by steaming at a temperature of up to 120° C.

It has now been found that flat textile articles, preferably combed material, made of wool or their mixtures with synthetic fibers can be dyed by means of 1:2 or 1:1 metal complex dyestuffs or by means of reactive dyestuffs continuously according to a pad-hot-dwell method, by padding a web of said textile material with an aqueous liquor containing a solution of said dyestuffs together with 80 to 120 g/l of a dissolved hydrotropic substance, placing the material thus treated, continuously and without intermediate drying, into a heated dwelling chamber, submitting the material in said chamber, during its passage in cuttled-up state, to the action of heat, at a temperature of from 85° to 95° C. for a period of from 30 to 60 minutes, so that the dyestuff is fixed by the dwelling operation, and finally withdrawing the dyed material again continuously from the dwelling chamber.

According to the process of the invention padding of the woollen material with the dye bath can be carried out at room temperature; temperatures in the range of from 70° to 80° C. being, however, preferred, as thus heating of the textile material in the dwelling chamber can be dispensed with and the total period of passage of the textile material through this installation can be used for the dyestuff fixation.

Heating of the textile material can alternatively be performed in an infrared tunnel placed before the dwelling chamber. Thereafter, no further energy supply takes place excepting the amount necessary for keeping the dwelling temperature in the chamber constant. Heating of the dwelling chamber by steam injection i.e. by steaming, must be excluded because of the danger of the formation of condensates and of a dilution of the liquor that has been padded on the material to be dyed.

Suitable hydrotropic substances are, for example, urea, thiourea, polyalkylene glycols having a molar weight of from 400 to 1000 or dimethyl sulfoxide.

The color intensity to be attained on woollen material in the process of the invention is very high and nearly reaches that obtained by the exhaustion process. It must be taken into consideration that metal complex or reactive dyestuffs are nearly completely exhausted in the exhaustion process. In the continuous process the dyestuff yield obtained amounts to about 90% of that obtained in the exhaustion process. The dyestuff yields obtained hitherto in pad-dwell processes range between about 10 and 20% of the complete yield; consequently, processes of this type according to the state of the art yielded only medium color intensities, in batchwise operation. In the process of the invention, extremely deep shades having very good fastness properties can be obtained in completely continuous operation, with a normal dyestuff feed and, moreover, the dyeing process is very easy technically. As the dyestuff yield is nearly complete, the reproducibility of the tints is extremely good.

Dyeings of such deep color intensity are obtained without using any of the conventional textile auxiliaries or additives, which are, for example, used in the process according to Belgian Pat. No. 607,179. The color intensity obtained is extremely surprising and was not to be expected at all by one skilled in the art. The easy and economic dyeing method is outstanding. Finally there are used no levelling agents.

According to the process of the invention textile material consisting of wool or containing wool, in whatever state of processing, can be dyed very fast and deep shades, especially without any tendering of the fiber. For the feed rates of urea ranging from 80 to 120 g/l, a damaging of the fiber by urea cannot take place. A tendering of the fiber is pronounced, however, for feed rates of urea of 300 g/l in the cold-dwell process according to the state of the art: Urea is a more or less efficient solvent for all proteins, the dissolving effect of which is the higher, the more the fiber properties of the woollen material have been detrimentally affected in a preceding treatment. Moreover, the complicated chemism involving a partial transformation of urea into isocyanate must be taken into consideration, as it has likewise a detrimental effect on the wollen fiber. When using polyalkylene glycols or dimethylsulfoxide there is no danger of a tendering of the wollen material. These substances have a similar effect as urea and the color yields which may be obtained therewith are nearly as good as that obtained with the addition of urea.

Suitable metal complex dyestuffs for the process of the invention are the relatively difficultly soluble 1:2 chromium or cobalt complex compounds of azo dyestuffs, especially of monoazo dyestuffs, i.e. complex compounds in which 2 molecules of an identical azo dyestuff or each time 1 molecule of two azo dyestuffs which are different from one another are linked in complex manner to one chromium or cobalt atom. The complex compound may contain, for example, a disazo dyestuff and a monoazo dyestuff or preferably two identical or different monoazo dyestuff molecules. Further metal complex dyestuffs include water-soluble metallized azo dyestuffs, containing per dyestuff molecule only one metal atom linked in complexe manner (1:1 metal complex compounds), especially copper, chromium or cobalt. These azo dyes contain as metal complex forming group preferably o,o'-dihydroxyazo groupings.

Suitable reactive dyestuffs for the process of the invention are any of the organic dyestuffs known by this term. These dyestuffs mainly include those containing at least one group capable of reacting with polyhydroxy fibers or with polyamide fibers, a precursor to this group or a substituent which reacts with the polyhydroxy or polyamide fiber. As basic structures of the organic dyestuffs that may be used, in particular those of the azo, anthraquinone or phthalocyanine series are suitable; the azo or phthalocyanine dyestuffs may be free from metal or may contain metal. As examples of reactive groups or precursors which form such reactive groups in an alkaline medium there may be mentioned epoxy groups, the ethylene imide group, the vinyl group in the vinylsulfone group or in an acrylic acid radical, besides the β-sulfatoethyl sulfone group or the β-chloroethyl sulfone group. For these processes, derivatives of the tetrafluoro-cyclobutyl series, for example of tetrafluoro-cyclobutyl-acrylic acid, may also be used. As reactive substituents in reactive dyestuffs there may be mentioned those substituents which can be split off easily and which leave an electrophilic radical. Examples of such substituents are halogen atoms in quinoxaline triazine, pyrimidine, phthalazine and pyridazone ring systems. Use may also be made of dyestuffs which contain several different reactive groups.

As colorants for carrying out the process of the invention there may be used alternatively the above dyestuffs which have previously been reacted with methyl taurine. In this case the reactive group of the dyestuffs is temporarily masked by methyl taurine. Dyestuffs of this type are known as being suitable for the dyeing of wool, however, they could be used only in the exhaustion process at boiling temperature or in continuous processes at a fixation temperature of from 100° to 120° C. A process of this kind is disclosed, for example, in German Auslegeschrift No. 2,340,044.

Because of the high exploitation of the dyestuffs according to the invention a feed rate of dyestuff as low as 30 g/l on the average will be sufficient. In the known discontinuous pad-dwell dyeing method more than 30 g/l of metal complex dyestuffs must be generally dissolved in order to obtain deep shades. Such high amounts of dyestuff however, can be dissolved only with difficulty.

The dyestuff yield in the process according to the invention is outstanding. The color intensity is no more improved by doubling or tripling the quantity of urea, polyglycol or dimethyl sulfoxide. A feed rate of urea of 300 g/l to the padding liquor yields the same shade and the same color intensity as a feed rate of urea of 100 g/l provided that the dyeing method hereinbefore described is used. The use of the lower quantity of urea, however, has the advantage that the wool is not tendered while the color intensity remains the same.

Dwelling periods of different length are advantageously applied in order to enable an operation as economic as possible, i.e. a rapid operation. Light shades require dwelling times of from 30 to 45 minutes, deep shades require a dwelling time of the material to be dyed in the heated dwelling chamber of from 45 to 60 minutes. Dwelling chambers which are known from German Offenlegungsschrift No. 2,406,257 with continuous passage of the goods to be dyed are especially appropriate for carrying out the process of the invention.

The process of the present invention comprises dissolving the 1:2 metal complex dyestuffs and the 1:1 metal complex dyestuffs in hot water. The reactive dyestuffs are dissolved with hot water with the addition of sodium carbonate in an amount of about 1/10 of the weight of the dyestuffs. After cooling of the dyestuff solutions to about 70° C., 80 to 120 g/l of the hydrotropic substances, for example, urea, thiourea, polyalkylene glycol having a molar weight of from 400 to 1000 or dimethyl sulfoxide are added and the required volume of the dyestuff preparation is adjusted by adding cold or hot water. Finally the pH of the padding liquor is adjusted to about 5 by means of acetic acid.

Owing to the good evenness and yield in the process of the invention, the addition of particular levelling agents and fixation auxiliaries can be dispensed with, a thickening agent may be used, however, in order to obtain a uniform application. For this purpose completely etherified, non-ionic product based on locust bean floor have proved advantageous.

The goods to be dyed are padded with a liquor pick-up ranging from 70 to 110% (calculated on the weight of the dry goods), suitably at a temperature of more than 60° C. and the padded goods are introduced thereafter into the heated dwelling chamber in continuous manner. A constant temperature in the range of from 85° to 95° C. prevails in this chamber. The goods to be dyed are deposed in humid state on the conveying means (dwelling means) of the dwelling chamber and pass through the chamber within the intended dwelling period of from 30 minutes to one hour. Thereafter the dyed goods leave the chamber continuously and are submitted to an after-treatment.

The following examples illustrate the invention.

EXAMPLE 1

30 g of the 1:2 cobalt complex compound of the dyestuff corresponding to the formula

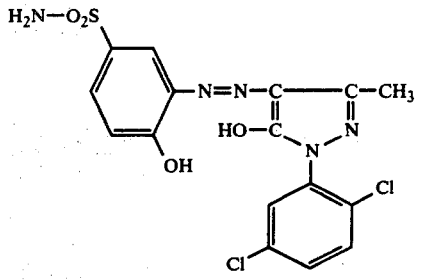

are thoroughly dissolved in 400 ml of hot water. After cooling of the solution obtained to about 70° C., 100 g of urea are added in solid state and dissolved. Thereafter 10 g of a completely etherified non-ionic locust bean flour thickening agent in the form of a 4% stock solution are added and the dyeing bath is filled up with water of 70° C. to give a total volume of 1000 ml and subsequently, the pH of the bath is adjusted to 5 by means of acetic acid of 30% strength.

This bath is used to pad a series of 8 woollen tops with a liquor pick-up of 100% (calculated on the weight of the goods). The combed woollen material is then guided through the padding device moving to and fro, directly introduced into a dwelling chamber according to FIG. 5 of German Offenlegungsschrift No. 2,406,257 and deposed on conveying belts therein. The temperature is this chamber is maintained at 90° C. The combed wollen material placed on the conveying belts passes through the hot dwell chamber within 60 minutes and is then withdrawn continuously for the after-treatment, which consists of a warm rinsing at a temperature of 60° C. and of a thorough cold rinsing. The goods are then after-treated on a back-washing machine.

There is obtained a full yellow-orange dyeing.

EXAMPLE 2

32 g of the 1:2 chromium complex compound of the dyestuff of the formula

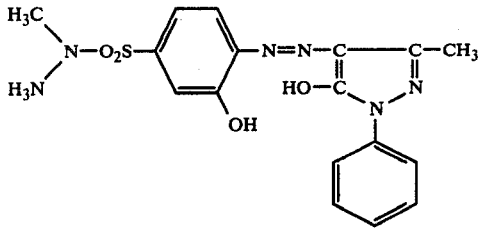

are dissolved in hot water and after cooling of the solution obtained to 70° C., 120 g of a polyethylene glycol having a molar weight of 600 are added. The liquor is filled up to a volume of 1000 ml by means of water having a temperature of 70° C., the pH is adjusted to 5 by means of acetic acid of 30% strength and 15 g of a 4% stock thickening agent prepared from a completely etherified locust bean flour product are added.

This liquor is used for padding a wollen fabric that had been shortly treated on a fulling machine, with a liquor pick-up of 95%, calculated in the weight of the goods, and the fabric padded at a temperature of 70° C. is directly introduced into a dwelling chamber according to FIG. 3 of German Offenlegungsschrift No. 2,406,257. The fabric thus treated is allowed to dwell on the conveying means for a period of 45 minutes, at a temperature of 90° C., while moving foreward. Thereafter the dyed fabric is withdrawn continuously from the dwelling chamber and submitted to a finishing operation by rinsing with water at 60° C. and by rinsing with cold water.

There is obtained a scarlet fast dyeing.

EXAMPLE 3

17 g of the reactive dyestuff of the formula

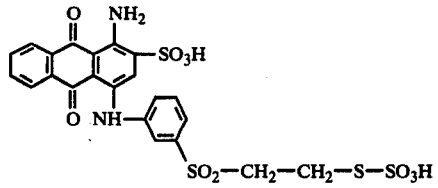

are mixed with 2 g of sodium carbonate and dissolved in boiling water. After cooling to 70° C., 90 g of urea are added to this solution and dissolved therein. The liquor is filled up to a volume of 100 ml by means of water having a temperature of 70° C. and the pH is adjusted to 5 by means of acetic acid. Finally 10 g of a locust bean flour stock thickening agent of 4% strength are added.

The padding liquor obtained is used for padding combed woollen material according to Example 1. The procedure is as in Example 1.

There is obtained a clear, fast blue dyeing.

Example 4

10 g of the reactive dyestuff of the formula

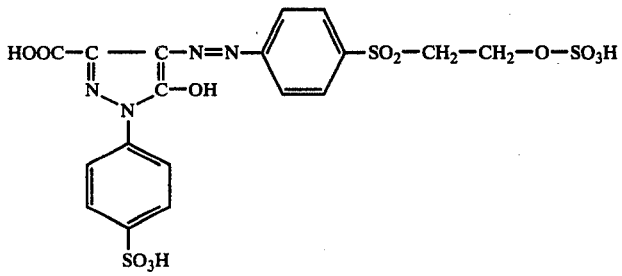

are dissolved together with 1 g of sodium carbonate in boiling water and the solution obtained is cooled to 70° C. After addition of 80 g of dimethyl sulfoxide the liquor is filled up to a volume of 1000 ml with water having a temperature of 70° C. and the pH is adjusted to 5 by means of acetic acid.

The liquor is used for padding a woollen fabric at a temperature 70° C. with a liquor pick-up of 100%, calculated on the weight of the goods, and the padded material is heated in an infrared tunnel to 95° C. Immediately after heating, the goods are deposed on conveying devices in a heated dwelling chamber where they are allowed to dwell for a period of 30 minutes, at 95° C. After having passed through the dwelling chamber, the dyed woollen fabric is withdrawn continuously and rinsed thereafter at 60° C. and with cold water.

There is obtained a clear, golden-orange dyeing having good fastness properties.

EXAMPLE 5

The dyeing procedure of a wollen fabric is performed as in Example 4, with the exception that 35 g of the reactive dyestuff of the formula

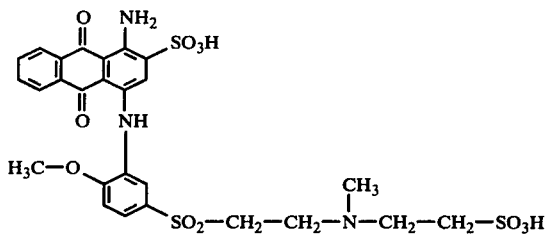

are used, instead of dimethyl sulfoxide, 120 g of urea. In the dwelling chamber there is a temperature of 95° C. The time of passage of the woollen fabrics is 1 hour. After having continuously withdrawn the woollen fabric from the chamber, the goods are treated in the first compartment of on open-width washing machine at a temperature of 80° C. in ammonia-containing water, at pH 8, rinsed thereafter with water at a temperature of 60° C., acidified and finally rinsed with cold water.

There is obtained a clear blue dyeing.

EXAMPLE 6

The procedure is as in Example 1, with the exception that 10 g of the reactive dyestuff of the formula

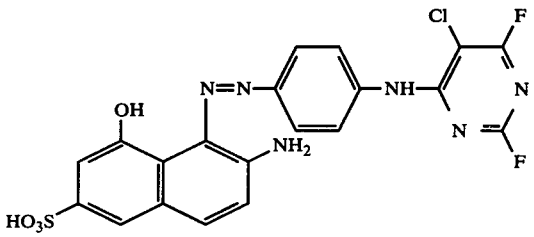

and 6 g of the reactive dyestuff of the formula

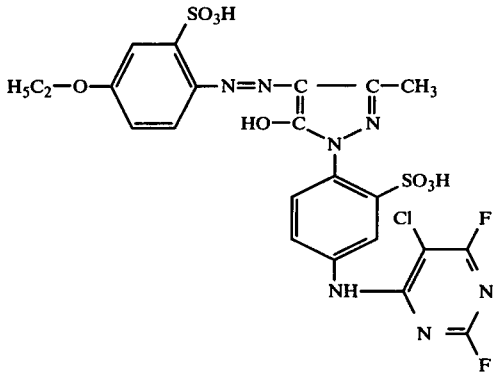

and 5 g of the reactive dyestuff of the formula

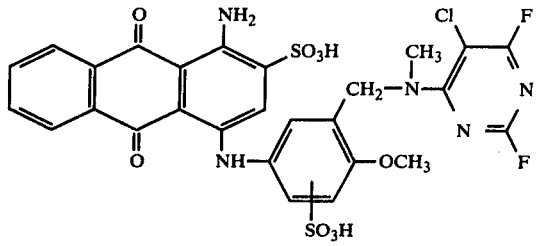

are used. After having performed the dyeing procedure as in Example 1 there are obtained combed woollen materials which are dyed brown and have good fastness properties.

EXAMPLE 7

When performing the dyeing procedure of a woollen material in the manner described in Example 2, but with the use of thiourea instead of polyethylene glycol, in the same quantity, the color intensity and the quality of the dyeing are the same as in Example 2.

EXAMPLE 8

When performing the dyeing procedure of Example 1 with the use of the 1:1 chromium complex compound of the dyestuff of the formula

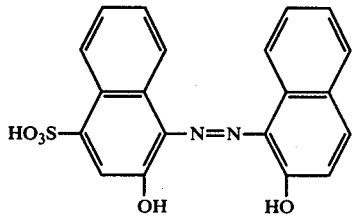

instead of the 1:2 metal complex dyestuff as described in this Example, there is obtained a blue dyeing.

EXAMPLE 9

An aqueous padding liquor having a temperature of 70° C. is prepared containing per liter 16 g of the 1:2 chromium complex compound of the dyestuff of the formula

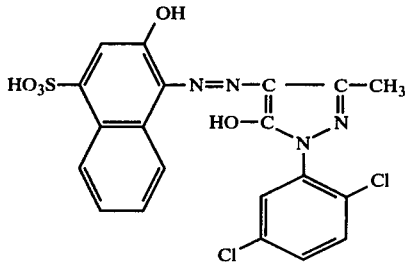

and 100 g of a polyethylene glycol having a molar weight of 600, 10 g of a 4% stock thickening agent obtained from a completely etherified locust bean flour product, and acetic acid for adjusting the pH at 6.

The padding liquor is used for padding a woollen material which had been treated for a short period of time on a fulling machine, with a liquor pick-up of 80%, calculated on the weight of the goods, the goods are heated in an infrared tunnel to 90° C. and the heated goods are introduced into a heated dwelling chamber, where there is a temperature of 90° C. The fabric is deposed on the conveying and dwelling means of the chamber and passed through the dwelling zone within a period of 45 minutes. The dyed fabric is withdrawn continuously from the last of the conveying belts and submitted in continuous manner to an after-treatment by rinsing with water having a temperature of 60° C. and by cold rinsing.

There is obtained a bordeaux colored dyeing having good fastness properties.

EXAMPLE 10

The Example is performed using, instead of the dyestuff of Example 9, 27 g of the reactive dyestuff of the formula

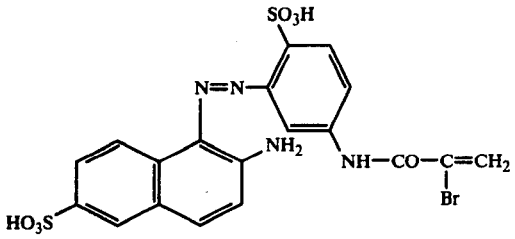

and, instead of polyethylene glycol, 120 g of dimethyl sulfoxide, the remainder of the procedure being as in Example 9.

There is obtained a clear orange dyeing.

EXAMPLE 11

The Example is performed using, instead of the dyestuff of Example 9, 18 g of the reactive dyestuff of the formula

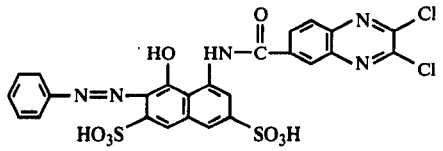

and, instead of polyethylene glycol, 80 g of urea. The rest of the procedure is as in Example 9.

There is obtained a red dyeing having good fastness properties.

We claim:

1. In a process for the dyeing of flat textile articles made of wool or mixtures thereof with synthetic fibres, by means of 1:2 or 1:1 metal complex dyestuffs or reactive dyestuffs, in the presence of a hydrotropic substance, and fixation of the dyestuffs by means of a dwelling operation, the improvement which comprises: continuously padding a web of said textile material with an aqueous liquor containing a solution of at least one of said dyestuffs together with 80 to 120 g/l of a dissolved hydrotropic substance selected from the group consisting of urea, thiourea, a polyalkylene glycol having a molecular weight of 400 to 1000 and dimethylsulphoxide; bringing the material thus treated continuously and without intermediate drying into a heated dwelling chamber; submitting the material in said chamber during its passage in a cuttled-up state to the action of heat at a temperature of from 85° to 95° C. for 30 to 60 minutes; and continuously withdrawing the dyed material from the dwelling chamber.

2. A process as claimed in claim 1, wherein the padding operation is carried out at a temperature of from 70° to 80° C.

3. A process as claimed in claim 1, wherein the padded wool is heated, prior to entering the heated dwelling chamber, to a temperature of from 85° to 95 ° C. in an infrared tunnel.

4. A process as claimed in claim 1, wherein the time of passage of the padded textile material through the dwelling chamber, is in the range of from 30 to 45 minutes, for light shades, and of from 45 to 60 minutes, for deep shades.

* * * * *